United States Patent [19]

Stuber

[11] 3,946,569

[45] Mar. 30, 1976

[54] METHOD AND MEANS FOR INSTALLING A POST

[76] Inventor: Ivan L. Stuber, 1026 N. Lightner, Wichita, Kans. 67208

[22] Filed: Mar. 3, 1975

[21] Appl. No.: 554,409

Related U.S. Application Data

[63] Continuation-in-part of Ser. No. 487,543, July 11, 1974, abandoned.

[52] U.S. Cl. ..... 61/53.5; 52/166; 166/285; 256/32

[51] Int. Cl.[2] ..... E02D 5/80; E04H 17/22

[58] Field of Search ..... 256/32; 61/53.5, 53, 50; 166/285, 187, 292, 191, 179, 241, 243; 52/166, 169, 170

[56] References Cited

UNITED STATES PATENTS

| | | | |
|---|---|---|---|
| 237,172 | 2/1881 | Dentler | 52/166 |
| 573,777 | 12/1896 | Fry et al. | 52/166 |
| 1,513,228 | 10/1924 | Crotto | 166/187 X |
| 2,725,264 | 11/1955 | Bodine, Jr. | 166/241 X |
| 2,922,478 | 1/1960 | Maly | 166/187 X |
| 3,387,656 | 6/1968 | Guest et al. | 166/242 X |
| 3,494,134 | 2/1970 | Jorge | 52/166 X |
| 3,578,083 | 5/1971 | Anderson et al. | 166/187 X |
| 3,706,204 | 12/1972 | Long | 61/53.5 X |

*Primary Examiner*—Stephen J. Novosad
*Attorney, Agent, or Firm*—John H. Widdowson

[57] ABSTRACT

A method and means for installing a post, pole, or the like in a hole having fluid. A plurality of bracelet members are attached to the post. Each of the bracelet members have a covering and an elastomeric material for expanding which is encased in the covering.

24 Claims, 9 Drawing Figures

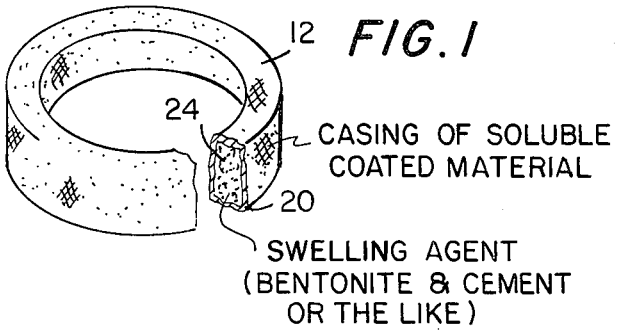
FIG. 1
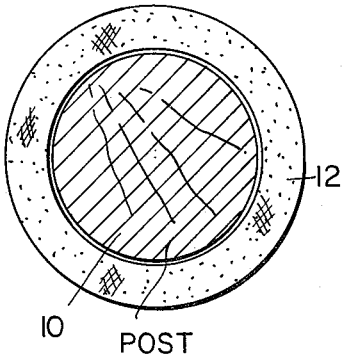
FIG. 2
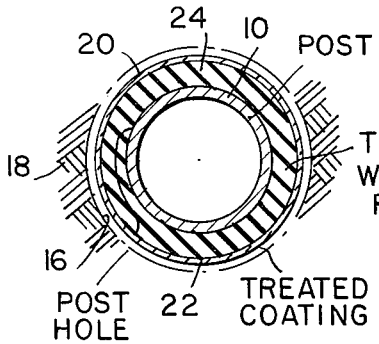
FIG. 3
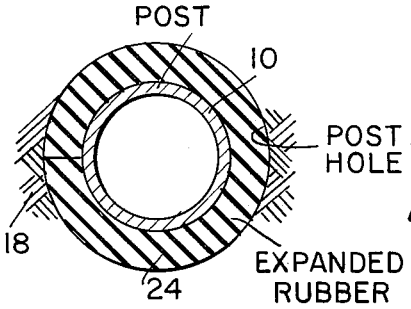
FIG. 4
FIG. 6
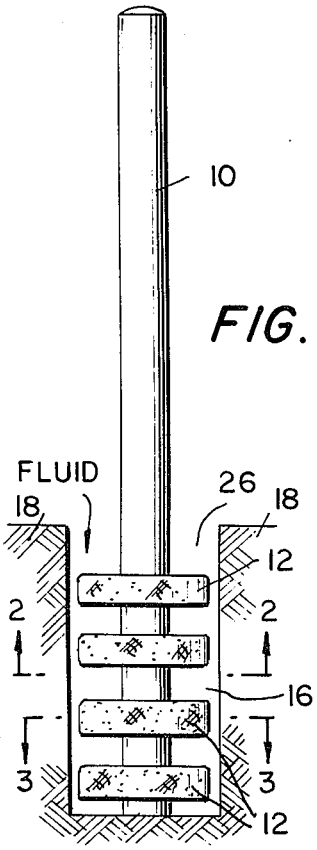
FIG. 5
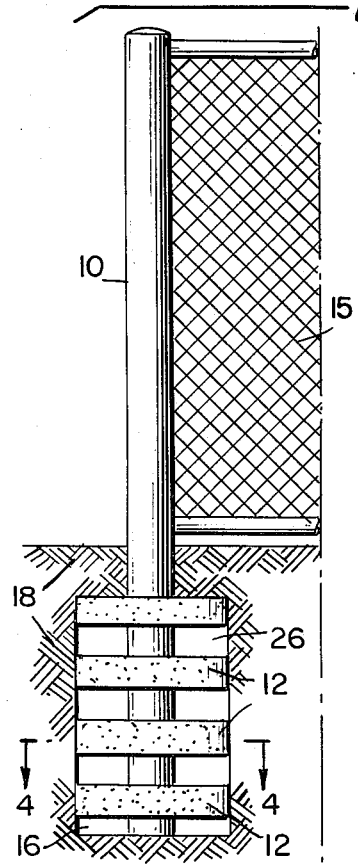
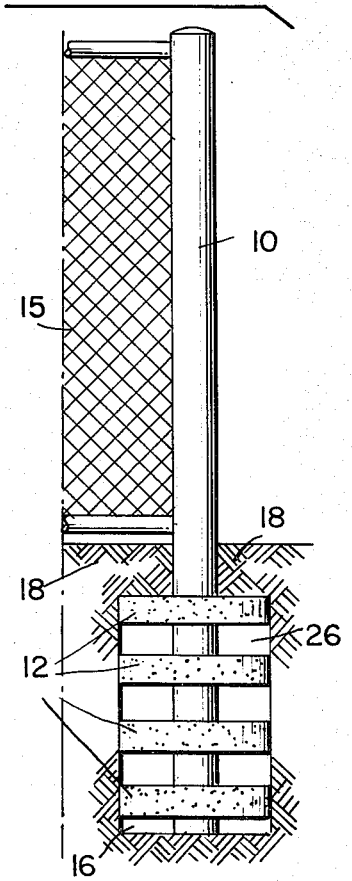

METHOD AND MEANS FOR INSTALLING A POST

This is a continuation-in-part application of my copending application Ser. No. 487,543, filed July 11, 1974 abandoned.

BACKGROUND OF THE INVENTION

1. Field of the Invention

This invention is related to a method and means for installing a post. More specifically, this invention provides a method and means for installing a post, a pole, or the like, in a hole having fluid.

2. Description of the Prior Art

Conventional means and methods for installing a post, a pole, or the like, include mixing a cement with water on the surface of the earth to produce a cement slurry which is dumped in the annulus situated between the hole and outside of the pole. Such prior art means and methods make use of a cement truck, rocks, sand and/or gravel. These conventional means and methods are uneconomical because of the cost of leasing a cement truck and the quantity of cement, rocks, and sand needed, and the time while mixing and performing the cementation and waiting for the cement slurry to setup. Good cement jobs are not guaranteed by conventional installing means and methods and quite often additional cement jobs are necessitated because of excessive cracking, deterioration, and etc. Therefore, what is needed and what has been invented by me is a method and means for implanting a pole, a post, or the like, without the deficiencies associated with the prior art.

SUMMARY OF THE INVENTION

The present invention accomplishes its desired objects by broadly providing a method and means for installing a post, pole, or the like, in a hole having fluid which comprises a plurality of bracelet members attached to the pole. Each of the bracelet members include a covering and an elastomeric means for expanding. The elastomeric means for expanding is encased in the covering.

It is therefore an object of the present invention to provide a method and means for installing a post, a pole, or the like, which generally produces no "bad" cement jobs.

It is another object of the present invention to provide a method and means for installing a post, pole, or the like, in a hole having a fluid in order to mount a fence, a sign, or the like, on the post.

It is yet another object of the present invention to provide a method and means for installing a fence post, or flag pole, or the like, which is much more economical than conventional methods and means.

These, together with various ancillary objects and features which will become apparent to those artisans possessing ordinary skill in the art as the following description proceeds, are attained by this novel method and means for implanting a post, a preferred embodiment being shown in the accompanying drawings, by way of example only, wherein:

BRIEF DESCRIPTION OF THE DRAWINGS

FIG. 1 is an enlarged perspective view of a bracelet member having a casing or cover enclosing a swelling or an elastomeric agent;

FIG. 2 is a horizontal sectional view taken along the line 2—2 in FIG. 5;

FIG. 3 is a horizontal sectional view taken along the line 3—3 in FIG. 5;

FIG. 4 is a horizontal sectional view taken along the line 4—4 in FIG. 6;

FIG. 5 is a partial vertical sectional view of a post having a plurality of compressed bracelet members attached thereto which include a covering having a protective coating therein;

FIG. 6 is a partial enlarged vertical sectional view of a fence having two poles, each of which having bracelets attached thereto in an expanded situation after the protective coating has been dissolved by the fluid allowing same to pass through the covering and mix with the swelling agent;

DETAILED DESCRIPTION OF THE INVENTION

Figure 7:
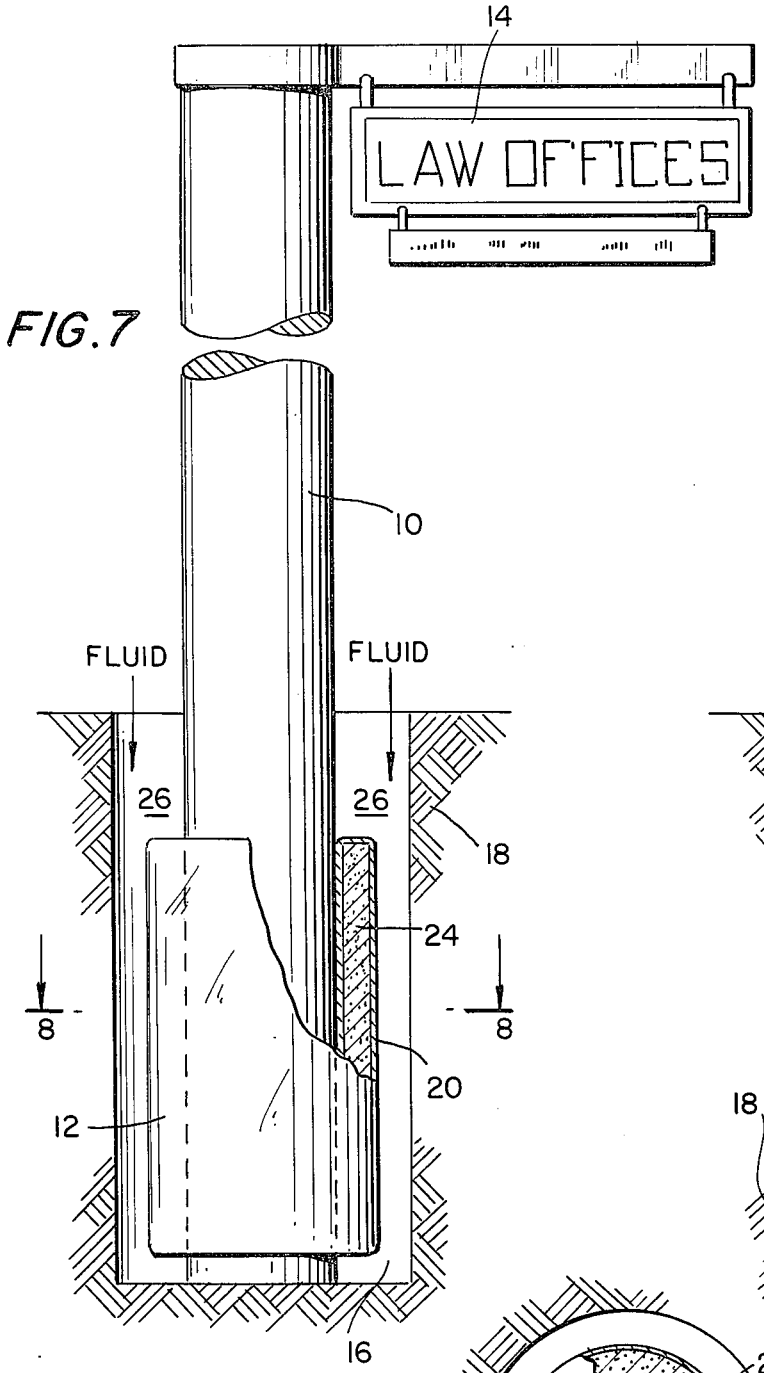
FIG. 7 is a partial vertical sectional view of a post having a bracelet attached thereto which has a protective coating enclosing cement.

Referring in detail now to the drawings wherein like or similar parts of the invention are identified by the same reference numerals, a post 10, having a plurality of bracelet members 12, a sign 14 or a wire (paged) fence 15 attached thereto, is situated within a hole 16 augered in a terrane 18. Each bracelet 12 includes a perforate (e.g. burlap) or imperforate covering 20 and/or a protective coating or wrapping 22 with a swelling or elastomeric agent 24 encased therein. Hole 16 contains a fluid 26 which may include water, acid, chemicals, or the like, for reacting and/or dissolving the protective coating 22 after a predetermined time has elapsed to allow the swelling agent 24 to come into contact with the fluid 26 and expand to hold the post 10 firmly in place in the hole 16. Swelling agent 24 may be a cement which forms a cement slurry 28 after mixing with the fluid 26.

With continual reference to the drawing for operation of the invention, bracelets 12 are attached to the post 10 before situating in the hole 16. The bracelet covering 22 may be either perforate or imperforate.

FIGS. 5 and 6 disclose one preferred covering embodiment of the bracelets 12 wherein post 10 is wrapped with a 1 to 6 inch wide burlap, or similar, covering 20 having a swelling agent compound 24 encased therein which will expand to at least twice its size when exposed to the fluid 26. Fluid 26 may be placed in hole 16 either before or after post 10 is inserted therein. The swelling agent compound 24 may be any means for expanding which are well known to those skilled in the art such as the following: kaolin, gel, sodium montmorillonite or any montmorillonite clay, salts including sodium or calcium chloride, plastics which swell upon heating, cement, and mixtures of the foregoing.

In this perforate covering embodiment of the invention bracelets 12 include a protective coating 22 which will dissolve at a certain temperature or after a predetermined time in order for the fluid 26 (i.e. water, acid, chemicals, etc. or mixtures thereof) to seep through the perforate covering 20 and come into contact with the swelling agent 24 which expands to either enlarge or burst the covering 20. The protective coating 22 may be any suitable coating which deforms or melts to allow seepage of the fluid 26 through the perforate covering 20. In a preferred embodiment of the invention the protective coating is a wax having a predetermined melting temperature. Warm or hot fluid 26 can be poured into hole 16 to melt the wax. Any wax species well known to those in the art may be utilized such as those found in the various editions of Kirk-Othmer Encyclopedia of Chemical Technology, By Interscience Publishers, a division of John Wiley & Sons, Inc., New York--London.

After the swelling agent 24 has expanded it will "set up" and be able to hold and implant the post 10 in the hole 16. Sign 14 or fence 15 may subsequently be attached to the post 10. The tensile strength of the bracelets 12 will be supplemented by the pressure strength of the compressed fluid 26 entrapped between the expanded bracelets 12 which are preferably spaced 1 to 3 inches apart. This can be clearly seen in FIG. 6.

Figure 8:
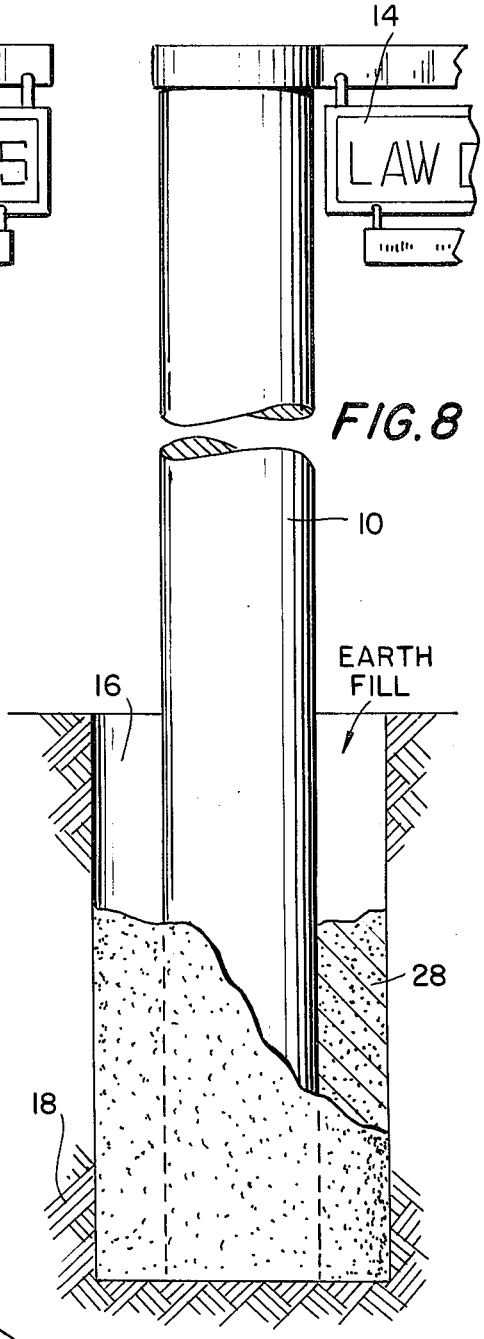
FIG. 8 is a horizontal sectional view taken along the line 8—8 in FIG. 7.
Figure 9:
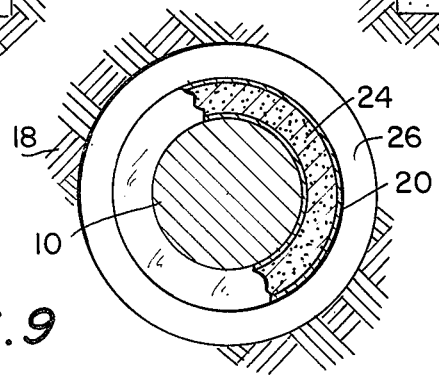
FIG. 9 is a partial vertical sectional view of the post in FIG. 7 with the protective coating of the bracelet dissolved by the fluid, allowing the cement to mix with the fluid to produce a cement slurry.

FIGS. 7 and 9 disclose another preferred covering embodiment of the bracelets 12 wherein bracelets 12 include a material expansion means 24 which can be wrapped around the post 10 tightly in a compressed manner. In a preferred embodiment of the invention the material expansion means is either sponge or soft rubber which is capable of being held in a compressed position (as seen in FIG. 3) while placing the post 10 in the hole 16 by some sort of a protective coating (or some sort of wrapping) which is capable of being dissolved by pouring an acid (e.g. sulphuric, hydrochloric, etc.) to react with the coating or wrapping to dissolve same in a predetermined time. After the protective covering or coating is dissolved, the compressed material expansion means 24 expands against the side of the drilled hole 16 as illustrated in FIGS. 4 and 9. Also illustrated in FIG. 9 is a cement slurry 28 being upheld by the bottom of hole 16 after the protective coating or covering of cement swelling agent 24 in FIG. 8 has been dissolved to allow the dry cement to mix with the drilling fluid 26 preferably water, to form the slurry 28. The cement slurry 28 may be upheld by an expanded means 24 (vice the bottom of hole 16) after the protective coating or covering has been dissolved; this is not shown in the drawings but is clearly shown in the drawings or my co-pending patent application. The entire joint of post 10 in FIG. 7 can be wrapped with protected dry cement if deemed necessary.

There are various embodiments of use for the bracelets 12. One use embodiment is to utilize a swelling agent 24 including a mixture of a clay, such as bentonite which swells to 12 to 14 times its original volume when water is added, in conjunction with a cement. This mixture will harden after expanding. Another use embodiment is to use alternating layers of the swelling agent 24 having bentonite and the swelling agent 24 consisting of cement. This method of using depends on the expansion of the bentonite swelling agent to compress the cement swelling agent out against the side of the augered hole 16 before setting up. Still yet another use is to have, as aforementioned, the sponge, rubber, or bentonite swelling agent at the bottom of the post 10 for swelling against the wall, and the bracelet or bracelets 12 above containing only dry cement in order to produce a cement slurry (after dissolution of the bracelet coating) which settles downward where it will be either upheld by a bottom bracelet (not shown in the drawings) or the bottom of hole 16 until it sets up between the post 10 and the side of the hole 16. Of course the setting time of the cement can be either retarded or accelerated by additives well known to those skilled in the art.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A means for installing a post, pole, or the like, in a hole having a fluid which comprises;

a plurality of bracelet members attached to the post;

a covering over each of said bracelet members, said covering having a protective coating that will dissolve in the fluid after a predetermined time has elapsed; and elastomeric means in said bracelet members for expanding, said elastomeric means encased in said covering, said elastomeric means when coming into contact with the fluid expanding to hold the post firmly in place in the hole.

2. The means of claim 1 wherein said covering is a perforate covering.

3. The means of claim 1 wherein said fluid includes an acid which will react with said covering and dissolve it in a predetermined time.

4. The means of claim 1 wherein said means for expanding is selected from the group consisting of sponge and rubber; said sponge and rubber being held in a compressed position while said pole, post, or the like, is being situated into said hole for installation.

5. The means of claim 1 wherein at least one of said plurality of bracelet members include said elastomeric means comprising dry cement, said dry cement after said covering dissolves mixes with said fluid to produce a cement slurry to be hardened around said post, pole or the like.

6. The means of claim 1 wherein said perforate covering includes burlap.

7. The means of claim 1 wherein said means for expanding is selected from the group consisting of kaolin, gel, sodium montmorillonite, montmorillonite clay, plastics which swell upon heating, cement, and mixtures thereof.

8. The means of claim 1 wherein said protective coating includes a wax means which melts at a predetermined temperature.

9. A process for installing a post, pole, or the like, in a hole having a fluid in order to mount a fence, a sign, or the like, on the post, which comprises attaching a plurality of bracelet members to said post as same is being placed into said hole, each of said bracelet members include a covering and an elastomeric means for expanding said means for expanding being encased in said covering and expanding said bracelet members to secure the post in the hole.

10. The process of claim 9 wherein said covering is a perforate covering.

11. The process of claim 10 wherein said perforate covering includes burlap.

12. The process of claim 10 additionally including selecting said means for expanding from the group consisting of kaolin, gel, sodium montmorillonite, montmorillonite clay, plastics which swell upon heating, cement, and mixtures thereof.

13. The process of claim 9 wherein said covering additionally includes a protective coating.

14. The process of claim 13 additionally including dissolving said protective coating in said fluid after a predetermined time has elapsed to allow said means for expanding to come into contact with said fluid and expand to hole said post firmly in place in said hole.

15. The process of claim 13 additionally including melting said protective coating at a predetermined temperature.

16. The process of claim 15 wherein said protective coating comprises a wax.

17. The process of claim 9 wherein said covering is an imperforate covering.

18. The process of claim 17 additionally including dissolving said imperforate covering in said fluid after a predetermined time has elapsed to allow said means for expanding to expand against the side of said hole.

19. The process of claim 18 additionally including reacting said covering with an acid to dissolve same in a predetermined time, said acid being contained within said fluid.

20. The process of claim 18 additionally including holding said means for expanding in a compressed position while said post is being placed into said hole for implantation.

21. The process of claim 20 wherein said means for expanding is selected from the group consisting of sponge and rubber.

22. The process of claim 18 wherein at least one of said plurality of bracelet members include said elastomeric means comprising dry cement.

23. The process of claim 22 additionally including mixing said dry cement with said fluid to produce a cement slurry to be hardened around said post.

24. The process of claim 18 additionally including attaching a fence to said post.

* * * * *